United States Patent [19]

Alan

[11] Patent Number: 4,727,630

[45] Date of Patent: Mar. 1, 1988

[54] PLASTIC BUCKLE

[75] Inventor: Kong Alan, Yokohama, Japan

[73] Assignee: Nifco Inc., Yokohama, Japan

[21] Appl. No.: 920,486

[22] Filed: Oct. 17, 1986

[30] Foreign Application Priority Data

Nov. 8, 1985 [JP] Japan ..... 60-172181[U]

[51] Int. Cl.[4] ..... A44B 11/24

[52] U.S. Cl. ..... 24/585; 24/633

[58] Field of Search ..... 24/585, 584, 633, 16 R, 24/16 PB, 68 J, 70 J, 71 J

[56] References Cited

U.S. PATENT DOCUMENTS

| | | | |
|---|---|---|---|
| 1,483,853 | 2/1924 | Schwerd | 24/585 X |
| 1,823,043 | 9/1931 | Heugas | 24/585 |
| 2,069,559 | 2/1937 | Ritter | 24/71 J |
| 2,125,775 | 8/1938 | Eisenman | 24/585 |
| 2,412,164 | 12/1946 | MacLachlan | 24/584 |
| 2,474,372 | 6/1949 | Schmith | 24/585 |
| 3,900,923 | 8/1975 | Thomas | 24/16 PB |
| 4,552,407 | 11/1985 | Takada | 24/584 X |
| 4,577,377 | 3/1986 | Kasai | 24/633 X |

*Primary Examiner*—Kenneth J. Dorner
*Assistant Examiner*—James R. Brittain
*Attorney, Agent, or Firm*—Trexler, Bushnell, Giangiorgi & Blackstone, Ltd.

[57] ABSTRACT

A plastic buckle consisting of a one-piece plastic molding has a belt insertion hole defined by top and bottom walls facing each other and opposite side walls facing each other. The front wall of the buckle has a lock portion defined by a U-shaped slit-like opening. The lock portion is elastically deformable and has a lock pawl provided on the inner side of its end portion. The opposite side walls are provided with side holes communicating with the belt insertion hole. Operating members penetrate the side holes to be inwardly elastically deformed to be brought into contact with the side portions of the lock portion to cause an upward displacement of the free end of the lock portion.

1 Claim, 15 Drawing Figures

PLASTIC BUCKLE

FIELD OF THE INVENTION AND RELATED ART STATEMENT

This invention relates to a buckle formed as a one-piece molding which can releaseably lock an insertion member such as a belt.

In the prior art, to close the body of a Boston bag, a sport bag, etc. with a cover, a buckle has been used such that a belt secured to the cover is inserted through and locked by a buckle which is secured to the body of the bag.

FIG. 1 is a view showing a prior art example of the buckle of this type. Referring to the FIG. 1(*b*), reference numeral 1 designates a plastic belt. The belt 1 is provided on one side with tooth-like lock grooves 2 each having an edge-like sharp bottom. The buckle is secured to the cover 4*a* of the Boston bag, sport bag, etc. by a rivet 5 or the like.

Reference numeral 6 designates a metal buckle for locking the belt 1. As shown in FIG. 1(*a*), the buckle 6 has a bottom 7*c* and side walls 7*a* and 7*b* perpendicularly projecting therefrom. A shaft 8 is mounted between the side walls 7*a* and 7*b*. A rotary lock member 9 is rotatably mounted on the shaft 8. The rotary lock member 9 is urged by a spring 10 provided on the shaft 8 such that its pawl portion 9*a* provided at one end is urged toward the bottom 7*c*.

The buckle 6 is secured to the body 4*b* of the Boston bag, sport bag, etc. with a rivet 12 fitted through a mounting hole 11 formed in one end portion of the bottom 7*c* of the body.

As the belt 1 is inserted through the buckle 6 from its free end, it strikes the pawl portion 9*a* of the rotary lock member 9 and raises the pawl portion 9*a* against the urging force of the spring 10 while proceeding through the buckle. When the pawl portion 9*a* is engaged in one of the lock grooves 2 of the belt 1, the belt 1 is locked against retreat.

To withdraw the belt 1 from the buckle 6, the other end 9*b* of the rotary lock member 9 is depressed in the direction of the arrow in FIG. 1(*b*) against the biasing force of the spring 10 to release the engagement between the pawl portion 9*a* and the lock groove 2, whereby the belt 1 can be withdrawn.

This prior art buckle 6, however, is made of metal and has a large number of component parts. Therefore, its assembly is troublesome and time-consuming, thus leading to high cost. Further, the buckle is apt to rust because it is made of metal. Further, it is impossible to select a desired color for the buckle.

Further, to release the lock the rotary lock member 9 is depressed on the front side of the buckle 6. Therefore, in the case of a soft Boston bag, sport bag, etc., the body of the bag itself is liable to be depressed. Therefore, the operation of withdrawing the belt 1 is considerably cumbersome. Further, since the rotary lock member 9 is depressed on the front side of the buckle 6, when external force is applied to the buckle 6 in such circumstances as when the person carrying the bag is in a crowded train or the like, it is liable that the belt 1 will be withdrawn accidentally.

FIG. 2 shows a different prior art example of a buckle. Referring to the figure, reference numeral 13 designates a buckle consisting of a one-piece plastic molding.

This buckle 13 has a belt insertion hole 14. It has a lock member 15, which extends from the bottom 13*a* into the belt insertion hole toward the top wall 13*b*. The free end of the lock member 15 is provided on the upper side with a lock pawl 15*a*. As shown in FIG. 2(*b*), the free end of the lock member 15 is provided on the transversally opposite sides with upwardly projecting operating projections 16 so that the lock member 15 has a channel-shaped sectional profile. The operating projections 16 are found in notches 17 formed in opposite side walls 13*c* of the buckle 13.

As the belt 1 is inserted with the lock grooves 2 on the lower side through the belt insertion hole 14 as shown in FIG. 2(*c*), the lock member 15 of the buckle 13 is pushed down against its elastic restoring force. When the lock pawl 15*a* is engaged in the lock groove 2, the belt is locked against retreat.

To withdraw the belt 1 from the buckle 13, the operating projections 16 are depressed from the side of the top wall 13*b* of the buckle 13 toward the bottom 13*a* thereof against the elastic force of the lock member 15 to release the engagement between the lock pawl 15*a* of the lock member 15 and the lock groove 2. In this state, the belt 1 can be withdrawn from the belt insertion hole 14.

Since the buckle 13 is a one-piece plastic molding, it is low in cost and permits selection of a desired color.

In this buckle 13, however, the lock member 15 projects from the bottom wall 13*a* of the buckle 13 toward the top wall 13*b*, so that it increases the bulkiness of the buckle 13 by that much. That is, the buckle projects from the mounting surface of the body of the bag that much. Further, for the same reason the belt 1 is locked in a state at a level from the bottom 13*a* of the buckle 13. For this reason, the cover 4*a* cannot close the body 4*b* of the bag in a close contact state therewith. Further, again with this buckle 13 the operating projections 16 are depressed from the side of the top wall 13*b* of the buckle 13 toward the bag body 4*b* for withdrawing the belt 1. Therefore, in the case of a soft bag such as a Boston bag or sport bag, the body of the bag is depressed, so that it is cumbersome to withdraw the belt 1. Further, external force is apt to be applied to the front surface of the buckle 13 so that it is liable that the belt 1 will be withdrawn accidentally.

OBJECT AND SUMMARY OF THE INVENTION

An object of the invention is to provide a buckle consisting of a one-piece plastic molding, which can overcome the above drawbacks, and in which a belt or other inserted body can be locked in a closely contacted state with respect to its bottom and without danger of its being accidentally withdrawn due to an applied external force.

According to the invention, there is provided a plastic buckle consisting of a one-piece molding having a belt insertion hole defined by top and bottom walls facing each other and opposite side walls facing each other, a belt or the like member being inserted through the belt insertion hole, a lock portion defined by a U-shaped slitlike opening formed in the top wall and having a free end portion capable of elastic deformation, the free end portion of the lock portion being provided with an inner lock pawl, side holes formed in the opposite side walls and communicating with the belt insertion hole, and operating members penetrating the side holes to be inwardly elastically deformed to be brought into contact with the side portions of the lock portion to cause an upward displacement of the free end of the lock portion.

With the buckle according to the invention the operating portions are provided on its opposite sides, so that they do not increase the bulkiness of the buckle and do not cause accidental detachment when an external force is applied to them. Further, the belt or other inserted member can be readily withdrawn. Further, since the belt is locked in close contact with the bottom wall of the buckle, the cover can be locked in close contact with the buckle body.

The above and other objects and features of the invention will become more apparent from the following detailed description with reference to the accompanying drawings.

BRIEF DESCRIPTION OF THE DRAWINGS

FIG. 1(*b*) is a sectional view showing the buckle of FIG. 1(*a*) in use;

FIG. 2(*b*) is a sectional view taken along line II*b*—II*b* in FIG. 2(*a*);

FIG. 2(*c*) is a sectional view taken along line II*c*—II*c* in FIG. 2(*a*);

FIG. 2(*d*) is a sectional view showing the buckle shown in FIG. 2(*a*) with operating projections depressed;

FIG. 8 is an elevational sectional view showing the buckle shown in FIG. 3 with the operating projections pushed in;

DETAILED DESCRIPTION OF THE PREFERRED EMBODIMENT

Figure 1A:
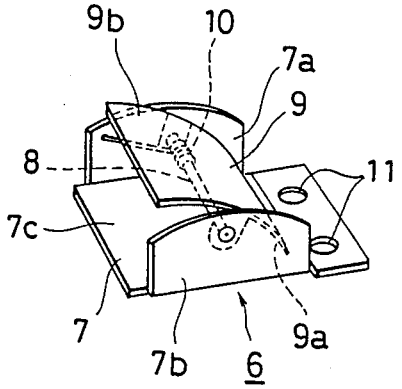
FIG. 1(a) PRIOR ART
FIG. 1(*a*) is a perspective view showing a prior art example of the buckle.
Figure 1B:
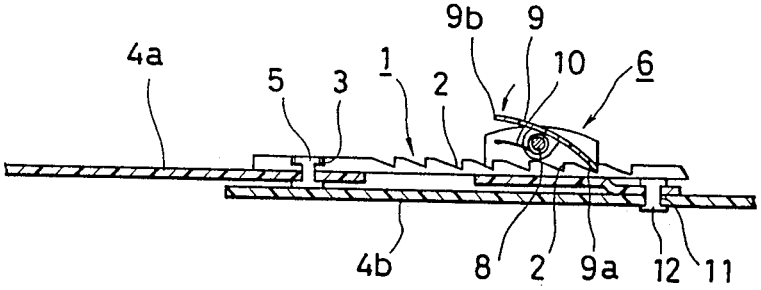
FIG. 1(b) PRIOR ART
Figure 2A:
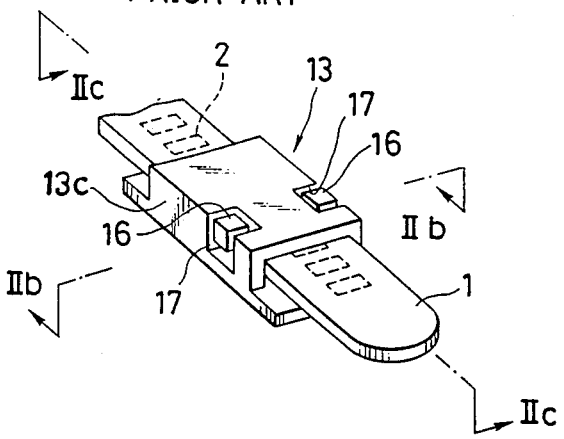
FIG. 2(a) PRIOR ART
FIG. 2(*a*) is a perspective view showing a different prior art example of the buckle.
Figure 2B:
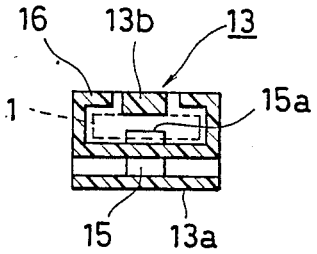
FIG. 2(b) PRIOR ART
Figure 2C:
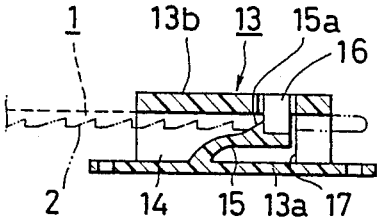
FIG. 2(c) PRIOR ART
Figure 2D:
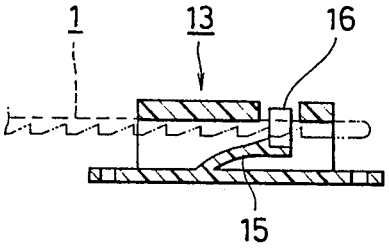
FIG. 2(d) PRIOR ART
Figure 3:
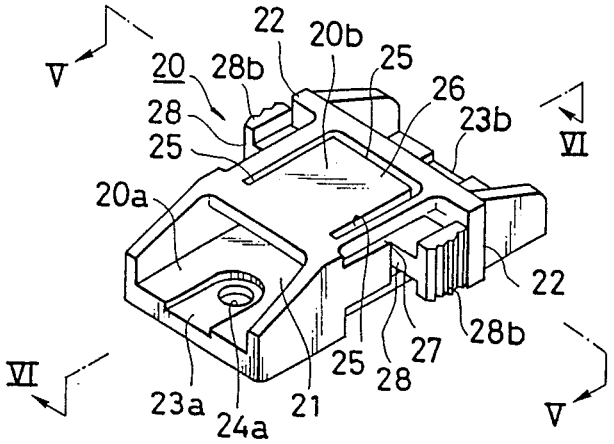
FIG. 3 is a perspective view showing an embodiment of the buckle according to the invention.
Figure 4:
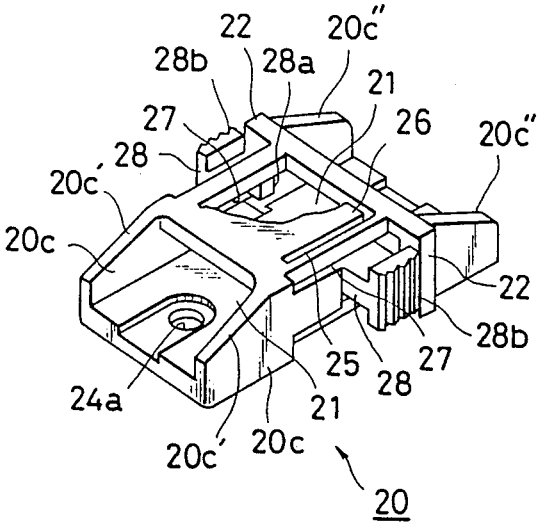
FIG. 4 is a perspective view, partly broken away, showing the buckle of FIG. 3.
Figure 5:
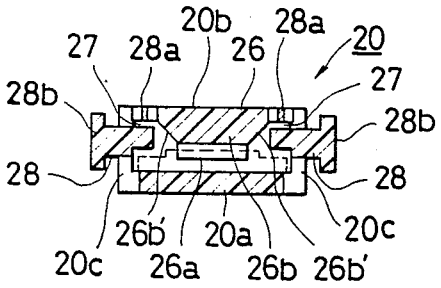
FIG. 5 is a sectional view taken along line V—V in FIG. 3.
Figure 6:
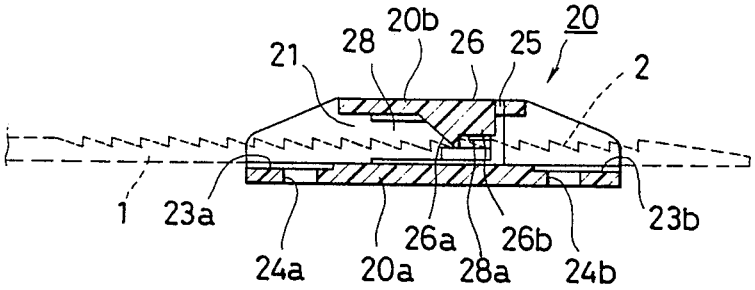
FIG. 6 is a sectional view taken along line VI—VI in FIG. 3.
Figure 7:
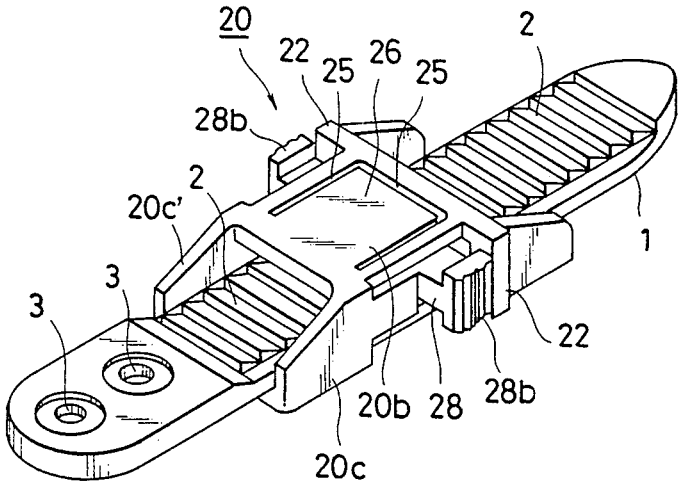
FIG. 7 is a perspective view showing the buckle shown in FIG. 3 with the belt locked.

FIGS. 3 to 7 illustrate a first embodiment of the plastic buckle according to the invention. Referring to the Figures, there is shown a buckle 20 having a belt insertion hole 21, which is defined by bottom and top walls 20*a* and 20*b* facing each other and opposite side walls 20*c* facing each other. The top wall 20*b* has a small length compared with the bottom wall 20*a*. Therefore, the side walls 20*c* each have tapered lengthwise end portions 20*c*′ and 20*c*″. The buckle has a reinforcement rib 22 projecting from each side wall 20*c* on the side of the tapered portion 20*c*″. The bottom wall 20*a* has depressed portions 23*a* and 23*b* formed adjacent to its opposite lengthwise ends. In the depressed portions 23*a* and 23*b* mounting holes 24*a* and 24*b* are formed, which are used to secure the buckle to the body of a bag such as a Boston bag or a sport bag. The top wall 20*b* is formed with a U-shaped slit-like opening 25 communicating with the belt insertion hole 21. The U-shaped opening 25 defines a lock portion 26 with a free end portion thereof capable of elastic deformation. As shown in FIGS. 5 and 6, the lock portion 26 has a lock pawl 26*a* extending from the back or inner surface of a free end portion and having an edge-like sharp end. The distance between the sharp end of the lock pawl 26*a* and the bottom wall 20*a* of the buckle is set to be slightly greater than the distance between the bottom of lock grooves 2 of the belt 1 and the lower surface thereof. Further, the back side free end portion of the lock portion 26 is provided with an increased thickness portion 26*b* having a trapezoidal sectional profile with tapered opposite side portions 26*b*′.

As shown in FIGS. 3 to 5, the side walls 20*c* are formed with side holes 27 communicating with the belt insertion hole 21. An operating member 28 penetrates each side hole 27 formed in each side wall 20*c*. It projects from the side wall 20*c* along the rib 22 and is capable of elastic deformation sidewise. Its inner end surface constitutes a contact surface 28*a* facing the corresponding tapered portion 26*b*′ of the increased thickness portion 26*b* of the lock portion 26. It has a stopper 28*b* provided at the outer end projecting from the side wall 20*c*.

The buckle 20 having the above construction is secured to the body of a bag, e.g., a Boston bag or a sport bag, using rivets (not shown) fitted in the mounting holes 24*a* and 24*b* formed in its bottom wall 20*a*. The belt 1 is secured with the lock grooves 2 directed up to the cover of the bag using a rivet or the like (not shown) fitted in the mounting hole provided adjacent to one end.

As the belt is inserted from its free end into the belt insertion hole 21 of the buckle 20, it proceeds with the back side in contact with the bottom wall 20*a* of the buckle 20 and raises the lock portion 26 in contact with the lock pawl 26*a* thereof. When the pawl 26*a* is engaged in one of the lock grooves 2, the belt 1 is locked against retreat as shown in FIGS. 5 and 6. When the belt 1 is inserted until the cover is sufficiently closed with respect to the body, the cover is held in a sufficiently closed state by the belt 1 and the buckle 20.

Figure 8:
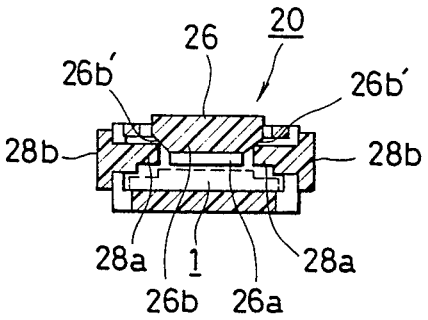
Figure 9:
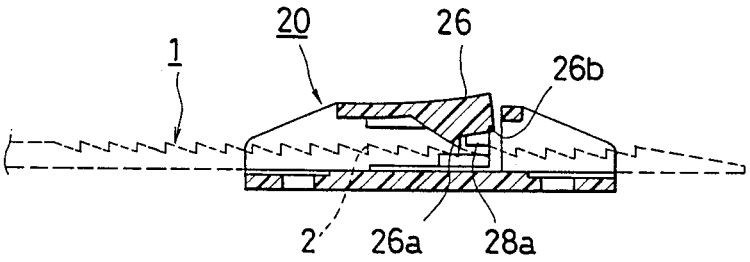
FIG. 9 is a side sectional view showing the same buckle.

To loosen or withdraw the belt 1, the stoppers 28*b* of the opposite side operating portions 28 of the buckle 20 are inwardly pushed with the fingers. As a result, as shown in FIGS. 8 and 9, their inner contact end surfaces 28*a* are brought into contact with the tapered portions 26*b*′ of the increased thickness portion 26*b* of the lock portion 26. By further inwardly pushing the stoppers 28*b*, the lock portion 26 is elastically deformed and upwardly displaced so that the lock pawl 26*a* is disengaged from the lock groove 2. Thus, the belt 1 can be readily loosened or withdrawn from the belt insertion hole 21.

Figure 10:
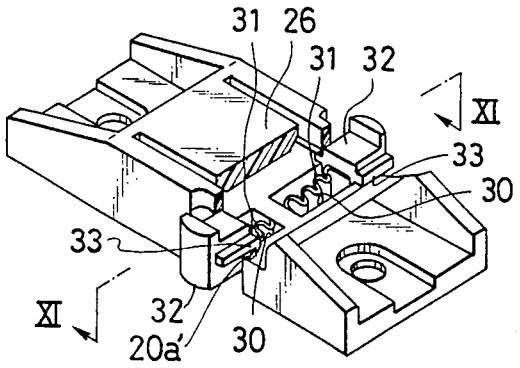
FIG. 10 is a perspective view showing a different embodiment of the buckle according to the invention.
Figure 11:
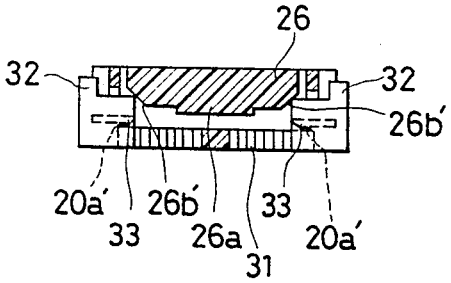
FIG. 11 is a sectional view taken along line XI—XI shown in FIG. 10.

FIGS. 10 and 11 illustrate a second embodiment of the buckle according to the invention.

In this embodiment, an intermediate portion of the bottom wall defining the belt insertion hole is formed with opposite side notches 30. In each notch 30, a bellows-like spring member 31 is accommodated. The outer end of the spring member 31 is provided with a substantially elongate operating portion 32. The side walls of the operating portions 32 are provided with stoppers 33 for contact with projections 20*a*′ provided on the opposite sides of the bottom wall 20*a*.

Thus, in this state, the stoppers 33 of the operating portions 32 are held in a state in contact with the projections 20*a'* by the urging force of the spring members 31. When the operating portions 32 are inwardly pressed against the urging force, the ends of the operating portions 32 are brought into contact with the opposite side tapered portions 26*b'* of the increased thickness portion 26*b* of the lock portion 26. Thus, the lock portion 26 is raised, and the lock pawl 26*a* thereof escapes from the lock groove 2 of the belt 1. When the operating portions 32 are released, the lock portion 26 restores to its initial state owing to the spring members 31, as shown in FIG. 11.

While two embodiments of the invention have been described above, they are by no means limitative, and various changes and modifications in the details of various parts are possible without departing from the scope of the invention. Further, the buckle may be used to lock an inserted member which has a single lock groove instead of the belt 1 having a plurality of lock grooves as noted above.

As has been described in the foregoing, with the buckle according to the invention the following effects can be obtained.

(i) The belt can be loosened or withdrawn by application of force to it in a direction parallel to the mounting surface of the Boston bag, sport bag, etc. Thus, the belt can be loosened and withdrawn easily even in case of a soft Boston bag, sport bag or the like.

(ii) For the same reason, the belt is safe from being accidentally loosened with respect to the front side of the Boston bag, sport bag, etc. due to external forces.

(iii) The belt is locked in close contact with the bottom wall of the buckle. Thus, the buckle does not become bulky. Further, the cover can be in close contact with the bag body in closing the same.

(iv) Since the buckle is a one-piece plastic molding, it is low in cost and is free from rusting. Further, it is readily possible to select various colors for the buckle.

What is claimed is:

1. A plastic buckle comprising a one-piece plastic molding having a belt insertion hole defined by top and bottom walls facing each other in spaced apart relation and opposite side walls facing each other, a belt or the like member being inserted through said belt insertion hole, a lock portion defined by a U-shaped slit-like opening formed in said top wall and having a free end portion capable of elastic deformation, said free end portion of said lock portion being provided with a depending lock member beneath said free end portion and having downwardly and inwardly tapering oblique side portions and having at its lower end an inner lock pawl, side holes formed in said opposite side walls and communicating with said belt insertion hole, and operating members penetrating said side holes and elastically deformable inwardly for each thereof engaging an oblique side portion of said lock portion to cause an upward displacement of the free end of said lock portion, and said one-piece plastic molding including an integral resiliently deformable connection between the molding and said operating members.

* * * * *